United States Patent [19]

Irish, Jr.

[11] 3,967,557

[45] July 6, 1976

[54] ADJUSTABLE ELECTRICAL TIME DELAY FUZE

[75] Inventor: Charles G. Irish, Jr., Port Tobacco, Md.

[73] Assignee: The United States of America as represented by the Secretary of the Army, Washington, D.C.

[22] Filed: Jan. 22, 1975

[21] Appl. No.: 543,287

[52] U.S. Cl. ..... 102/70.2 R
[51] Int. Cl.[2] ..... F42C 11/06
[58] Field of Search ..... 102/70.2 R

[56] References Cited

UNITED STATES PATENTS

| | | | |
|---|---|---|---|
| 1,897,863 | 2/1933 | Rühlemann | 102/70.2 R |
| 2,985,837 | 5/1961 | Ruehlemann et al. | 102/70.2 R |
| 2,996,991 | 8/1961 | Menzel | 102/70.2 R |

*Primary Examiner*—Charles T. Jordan
*Attorney, Agent, or Firm*—Nathan Edelberg; A. Victor Erkkila; Thomas R. Webb

[57] ABSTRACT

An electrical time delay fuze for exploding a projectile in air over a target comprises (1) a battery and voltage divider carried by the gun, (2) a firing circuit carried by the projectile including two capacitors initially connected in parallel with each other to be charged by the battery, prior to firing the gun, to two different voltages, switching means for subsequently connecting the capacitors in series with each other and with a timing resistor, and means for connecting the two capacitors to the cathode, anode and gate of a programmable unijunction transister (PUT) so that, after setback and projectile launch at firing, the two capacitors discharge through the resistor until the anode is sufficiently positive to the gate to cause the transistor to discharge through an electrical detonator and explode the projectile.

10 Claims, 1 Drawing Figure

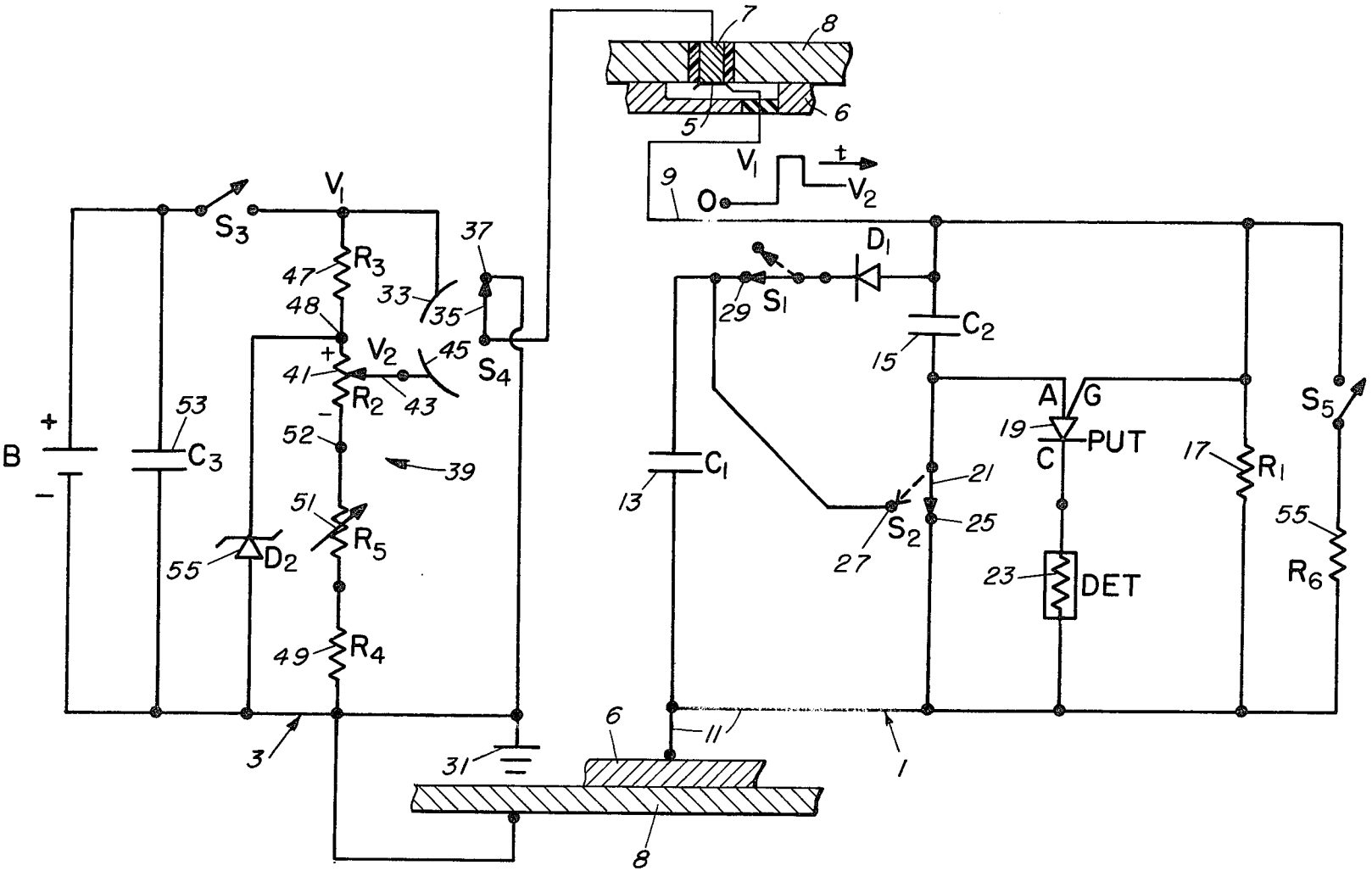
S5
R6
55
R1
17
G
PUT
A
C
19
DET
23
C2
15
21
25
S2
27
D1
S1
29
V2
V1
O
9
5
7
8
6
C1
13
11
1
6
8
31
S4
37
35
45
39
33
43
V2
R3
R2
R5
R4
V1
47
48
41
52
51
49
D2
55
3
S3
53
C3
B

ADJUSTABLE ELECTRICAL TIME DELAY FUZE

BACKGROUND AND SUMMARY OF THE INVENTION

The present invention relates to a delay fuze for exploding an explosive shell during flight at a predetermined time after launch, and particularly to an electrical delay fuze for a projectile launched from a shoulder-fired gun that is adjustable for air burst at particular ranges up to the instant of firing. For this purpose, part of the fuze is carried by the gun and easily adjustable by the operator to make last-minute corrections of the firing delay after observing previous target misses due to incorrect range settings. A typical target is a prone man who is not precisely located but presents a larger area to an air burst than to a ground burst. For example, the invention may be used with 26 mm ammunition fired from a semi-automatic weapon, with a 2.2 lb. secs. recoil impulse and a maximum range of about 1000 meters. The range of the target may be estimated visually or by a range-finding device. The estimated effectiveness of the new munition concept, as measured by the expected number of incapacitations per combat load, is several times that of either the current M-406 or M-397 40 mm munitions. The time delay component is additional to the normal mechanical impact component and the mandatory "safe-and-arm" component of the projectile fuze.

Conventional air-burst fuzes of the proximity type are too expensive and are unsuitable for the area fire concept which involves short range ground-to-ground combat situations and a relatively flat trajectory of the projectile. The costs of conventional digital time delay fuzes range from $10 to $25, making them impractical for the present concept. Conventional time delay fuzes containing a variable resistance tend to be impractical in a small volume fuze. Variable time delay has also been obtained by precharging a timing capacitor to a variable voltage before the start of the time interval. This has been done in the XM-433 fuze designed for a large caliber round.

In the present invention, the fuze comprises a DC power source, e.g. a battery, and a voltage divider carried by the gun and adapted to successively apply two different DC voltages to a firing circuit in the projectile. This firing circuit comprises two capacitors, initially connected in parallel with each other to be charged by the battery, prior to firing the gun, to two different voltages, switching means for subsequently connecting the two capacitors in series with each other and with a timing resistor, and means for connecting the two capacitors to the cathode, anode and gate of a unijunction transistor in such manner that, after setback and projectile separation from the gun at firing, the two series capacitors discharge through the timing resistor until the anode is sufficiently positive relative to the gate to cause the transistor to discharge through an electrical detonator and explode the projectile. The fuze may also include a mechanical impact fuze adapted to close a switch shunting the timing resistor, which causes the transistor to discharge, in the event of impact prior to the end of the electrical delay period.

BRIEF DESCRIPTION OF THE DRAWING

The single FIGURE of drawing is a schematic circuit diagram of an adjustable electrical time delay fuze embodying the present invention.

DETAILED DESCRIPTION OF THE PREFERRED EMBODIMENT

The single FIGURE of the drawing is a circuit diagram of a preferred embodiment of the present invention. The overall circuit consists of two parts, namely, a firing circuit 1 carried by an explosive projectile and a voltage supply circuit 3 carried by a gun from which the projectile is launched, detachably connected by conventional contacts 5 and 6 on the projectile and 7 and 8 on the gun, prior to firing the gun. The metal projectile housing and the metal gun barrel may constitute the contacts 6 and 8, respectively.

The firing circuit 1 comprises a first input terminal or line 9 and a second input terminal or line 11, connected to contacts 5 and 6, respectively. The first terminal 9 is connected through an isolation diode $D_1$ and an initially-closed, setback-actuated, single-pole-single-throw switch $S_1$ to one side of a first timing capacitor $C_1$, the other side of which is connected to the second terminal 11. A second timing capacitor 15 is initially connected, through one path of a setback-actuated, single-pole-double-throw switch $S_2$, to the terminals 9 and 11. A timing resistor 17 is connected across the terminals 9 and 11. Thus, the two capacitors 13 and 15 and the resistor 17 are all initially connected in parallel with the input terminals.

The anode terminal A of a programmable unijunction transistor (PUT) 19 is connected to the junction of the second capacitor 15 with the movable contact or pole 21 of switch $S_2$. The gate G of PUT 19 is connected to the first terminal 9, and the cathode C is connected, through an electrical detonator 23 for exploding the projectile charge (not shown), to the second terminal 11. The movable contact 21 of switch $S_2$ initially contacts a first fixed contact 25. A second fixed contact 27 of switch $S_2$ is connected to the junction of switch $S_1$ with the first capacitor 13, i.e. to a fixed contact 29 of switch $S_1$.

The voltage supply circuit 3 comprises a battery B having its negative side connected to the gun contact 8, and ground 31. The positive side of the battery B is connected, through a trigger-operated switch $S_3$, to one contact 33 of a single-pole-triple-throw switch $S_4$. The movable contact or pole 35 of switch $S_4$, connected to gun contact 7, is initially in contact with a second fixed contact 37 of the switch, which is connected to ground 31. A voltage divider resistor network 39 is connected across the battery, between the ground 31 and the junction of switch $S_3$ with contact 33. Resistor network 39 comprises at least a potentiometer 41, having its movable contact 43 connected to a third fixed contact 45 of switch $S_4$. Switch $S_4$ may be either a mechanical switch or an electronic switching circuit activated by either a mechanical switch or an electronic switching circuit activated by a trigger pulse from a contact on the gun trigger near the beginning of the trigger motion. Preferably, the network 39 also includes a maximum range resistor 47 connected in series with the positive terminal 48 of potentiometer 41, and a minimum range resistor 49 and temperature-compensating resistor 51 connected in series with the negative terminal 52 of potentiometer 41, as shown in the drawing. Resistor 51 varies with ambient temperature to compensate for the temperature variation of the characteristics of the transistor 19 and the timing network 13-15-17. Circuit 3 may also include a surge current capacitor 53 connected across the battery B, and a Zener diode $D_2$ connected across the delay voltage portion of the voltage divider network, i.e. between ground 31 and terminal 48, for regulating the delay voltage. Switches $S_3$ and $S_4$ could be separate from but located near the gun trigger, but are preferably operated directly by a three-position trigger connected to the switches. The divider network 39, when excited, applies a maximum voltage $V_1$ to contact 33, and a smaller selected voltage $V_2$ to contact 45, of switch $S_4$. The capacitor 53 provides a surge current capability to the voltage source to permit the capacitors in the fuze to be charged rapidly when necessary. Switch $S_3$ prevents a constant drain on the battery by the voltage divider 39. The high voltage $V_1$ provides the energy to operate the time delay circuit and explode the detonator 23. The voltage $V_2$ determines the selected delay time. The Zener diode $D_2$ minimizes the effect on the delay voltage $V_2$ of the battery voltage variation due to temperature and decreases the time required to set the voltage $V_2$ on the timing capacitor 15.

In operation, with the projectile chambered in the gun and the circuits 1 and 3 connected by contacts 5 through 8, the shooter closes the trigger-operated switch $S_3$, as by a partial pull on the gun trigger, thus connecting the battery B to voltage divider network 39 and switch $S_4$. Either before or after switch $S_3$ is closed, the potentiometer 41 is adjusted to produce the voltage $V_2$ for a selected range to the target. The switch $S_4$ is then actuated, as by a further pull on the gun trigger to a second position, to move contact 35 to contact 33, and hence, apply the voltage $V_1$ to the two timing capacitors 13 and 15, both of which are immediately charged to that voltage. At this time, the anode A of the PUT 19 is at zero or ground potential, as is the cathode C, while the gate G is at the positive potential $V_1$, hence, the PUT is inoperative and no current flows through the detonator 23.

Next, the switch $S_4$ is again actuated, as by a further pull on the gun trigger to a third position, to move the movable contact 35 to fixed contact 45. This connects the lower voltage $V_2$ across capacitor 15 and permits that capacitor to discharge, through the voltage divider network 39 until its voltage drops to the lower voltage $V_2$. Similar discharge of capacitor 13 is prevented by isolation diode $D_1$. Now the potential of the gate G of the PUT is $V_1$, which is still positive with respect to the anode A, so that the PUT is still inoperative. The relationship between the two voltages $V_1$ and $V_2$ is shown in the voltage diagram adjacent to the line 9 in the drawing.

The final movement of the trigger releases the gun sear and fires the projectile. On firing, the contacts 5 and 6 are separated from the contacts 7 and 8, by the forward motion of the projectile in the barrel, thus isolating the firing circuit 1 from its voltage supply circuit 3; and the switches $S_1$ and $S_2$ are actuated, by setback. Two separate switches could be used for $S_1$ and $S_2$. However, since switch $S_1$ must open before switch $S_2$ closes, it is preferable to gang the two switches together. Actuation of switch $S_2$ moves the movable contact 21 to contact 27, thus disconnecting capacitor 15 from the ground through contact 25 and also connecting capacitors 13 and 15 in series with each other and the timing resistor 17. Switch $S_1$ opens before switch $S_2$ is actuated, to prevent the rapid discharge of capacitor 15 through diode $D_1$ and switches $S_1$ and $S_2$. At the instant contact 21 contacts contact 27, the voltage $V_1$ of capacitor 13 is applied to the anode of the PUT 19 and to one side of capacitor 15, and the voltage on the gate G of the PUT is raised, by the voltage $V_2$ across the capacitor 15, to $V_1 + V_2$. The fuze is now electrically armed. The two capacitors immediately start discharging in series through timing resistor 17. If the capacitances $C_1$ and $C_2$ of capacitances 13 and 15, respectively, and the resistance $R_1$ of resistor 17 are suitably chosen, the polarity of the potentials on the anode A and gate G will reverse, and the anode A will become sufficiently positive relative to the gate G to cause the PUT 19 to discharge from the anode A to the cathode C and through the detonator 23, thus exploding the detonator and the explosive charge of the projectile. The potenial difference between the gate G and anode A required to produce this discharge is called the "valley point " $v$ of the PUT.

The time delay $t$ between the start of the capacitor discharge and the PUT discharge is:

$$t = C'R_1 \log_e \frac{V_1 + V_2}{(V_1 - V_2) - \frac{C_2}{C_1}(v + V_2)}$$

where $C' = \frac{C_1C_2}{C_1 + C_2}$

For an example, if $V_1 = 15$ volts, $V_2 = 5$ volts, $v = 1$ volt, $R_1 = 500$ K ohms, $C_1 = 20\ \mu f$, and $C_2 = 10\ \mu f$, the discharge or delay time is $t = 1.976+$ seconds. For a given projectile-gun combination, calibration charts showing the times required for the projectile to reach a series of ranges are readily available. For a given fuze having given battery voltage $V_1$, resistance $R_1$, capacitance $C_1$, capacitance $C_2$, and PUT valley point v, it is an easy matter, with the aid of a computer, to prepare a calibration chart showing the delay voltages $V_2$ required by the above formula for t to produce the delay times corresponding to a series of ranges. With such a chart, the shooter can adjust the delay voltage $V_2$ for a desired range, by manually adjusting the potentiometer 41, at any time prior to release of the gun sear, even though the timing capacitor 15 has been charged to a voltage corresponding to a different range. Moreover, the shooter can fire a first projectile at a particular range, noting visually whether the projectile exploded in front of or beyond the desired target, and immediately re-load and adjust the time delay of the next shot by a small amount to correct for the previous miss-hit, even without a calibration chart.

The above formula for t ignores the leakage currents associated with capacitors 13 and 15 and the PUT, and the temperature variation of the six parameters involved. The non-linearity of the delay time with the timing capacitor voltage $V_2$ is about 4%, or $\pm 2\%$. This non-linearity can be included in the potentiometer 41. A non-linear potentiometer will be necessary if the range adjustment of the gun sight is to automatically set the delay time, since the range varies as the sine of twice the angle of elevation of the gun.

Charging of the two capacitors prior to launch poses no threat to safety, because the electrical arming does not take place until setback has occurred.

Preferably, the projectile is also provided with a mechanical impact fuze, which would normally include some form of safing-and-arming means. The drawing also shows an optional feature wherein a switch $S_5$, operated by a mechanical impact fuze, is connected across the timing resistor 17. If the electrical delay fuze completes its function and explodes the detonator in flight before any impact, the switch $S_5$ remains open and does not affect the operation of the delay fuze. However, if the projectile impacts a target prior to completion of the operation of the delay fuze, closing of switch $S_5$ immediately reduces the voltage drop across resistor 17 to zero, reducing the potential of the gate G of the PUT to zero, causing the PUT to discharge through the detonator. A resistor 55, having a resistance $R_6$ lower than the resistance $R_1$ of resistor 17, may be placed in series with switch $S_5$ to provide a time delay between impact and explosion of the projectile.

What is claimed is:

1. In a system comprising a gun and an explosive projectile launched therefrom, delay fuze means for exploding said projectile during flight at a predetermined time after launch, including a firing circuit carried by said projectile, said firing circuit comprising:

first and second input terminals;

a first capacitor, and means connecting said first terminal, through a blocking diode and an initially-closed setback-actuated single-pole-single throw first switch and said capacitor, to said second terminal;

a second capacitor, and means connecting said first terminal, prior to setback, through said second capacitor and one path of a setback-actuated single-pole-double throw second switch, to said second terminal;

a timing resistor connected in parallel with said terminals;

a detonator for exploding the projectile;

a programmable unijunction transistor including an anode, a gate and a cathode and having its anode connected to the junction of said second capacitor and said second switch, its gate connected to said first terminal and its cathode connected, through said detonator, to said second terminal; and means connecting said transistor anode to the junction of said first switch and said first capacitor, through the other path of said second switch, when the latter is actuated by setback;

whereby the two capacitors can be charged to two different voltages prior to setback by supplying the two voltages successively to the two terminals, and will discharge in series through the timing resistor after setback until the anode of the transistor is sufficiently positive relative to the gate to cause the transistor to discharge through the detonator and thereby explode the projectile.

2. Delay fuze means as in claim 1, wherein said firing circuit further comprises:

a third switch, connected in parallel with said timing resistor, and adapted to be closed at impact of the projectile with a target to override the timing delay thereof.

3. Delay fuze means as in claim 2, further comprising a second time delay resistor connected in series with said third switch and said timing resistor, for providing a time delay after impact.

4. Delay fuze means as in claim 1, further including means carried by the gun for applying a first voltage to said input terminals prior to firing, to charge said capacitors to said first voltage, and then applying a lower voltage to said input terminals, for reducing the voltage across said second capacitor to said lower voltage.

5. Delay fuze means as in claim 4, wherein said voltage applying means comprises:

a battery having positive and negative terminals;

a voltage divider including a range-adjusting potentiometer, one end of said divider being connected through a first trigger switch to said positive battery terminal, the other end of said divider being connected to said negative battery terminal and also to said second input terminal by a first means disconnectible at launch; and a second trigger switch having a movable contact and at least two fixed contacts, said movable contact being connected to said first input terminal by a second means disconnectible at launch, one of said fixed contacts being connected to said one end of said voltage divider to apply said first voltage to said firing circuit; the other of said fixed contacts being connected to a movable contact of said potentiometer to apply said lower voltage to said firing ciruit.

6. Delay fuze means as in claim 5, wherein said voltage applying means further comprises a surge current capacitor connected across said battery.

7. Delay fuze means as in claim 5, wherein said voltage divider further includes a fixed resistor in series with said potentiometer, between the potentiometer and said one divider end, to determine a maximum delay for said firing circuit.

8. Delay fuze means as in claim 5, wherein a Zener diode is connected across said potentiometer, to regulate the delay voltage.

9. Delay fuze means as in claim 5, wherein said voltage divider further includes a fixed resistor in series with said potentiometer, between said potentiometer, and said other divider end, to determine a minimum delay for said firing circuit.

10. Delay fuze means as in claim 5, further including a temperature-sensitive variable resistor in series with said potentiometer, between said potentiometer and said other divider end, to compensate for the temperature variation of the characteristics of said transistor and the timing resistor.

* * * * *